US009926104B2

(12) United States Patent
Olarte

(10) Patent No.: US 9,926,104 B2
(45) Date of Patent: Mar. 27, 2018

(54) CONTAINER SYSTEM AND APPARATUS

(71) Applicant: Alvaro Mauricio Olarte, Aventura, FL (US)

(72) Inventor: Alvaro Mauricio Olarte, Aventura, FL (US)

(73) Assignee: Stackcan LLC, Aventura, FL (US)

( * ) Notice: Subject to any disclaimer, the term of this patent is extended or adjusted under 35 U.S.C. 154(b) by 0 days.

(21) Appl. No.: 14/811,378

(22) Filed: Jul. 28, 2015

(65) Prior Publication Data

US 2017/0029168 A1 Feb. 2, 2017

(51) Int. Cl.
*B65D 21/02* (2006.01)
*B65D 25/28* (2006.01)

(52) U.S. Cl.
CPC ..... *B65D 21/0202* (2013.01); *B65D 21/0212* (2013.01); *B65D 21/0231* (2013.01); *B65D 25/2802* (2013.01)

(58) Field of Classification Search
CPC B65D 21/02; B65D 21/0209; B65D 25/2805; B65D 25/38; B65D 25/56; B65D 85/70
USPC ..... 220/4.26, 4.27, 23.2, 23.6, 608, 669; 206/509
See application file for complete search history.

(56) References Cited

U.S. PATENT DOCUMENTS 3,583,590 A 6/1971 Ferraro
3,757,984 A * 9/1973 Barton ..... F01P 11/029 123/41.14
3,933,268 A 1/1976 Buske
D253,034 S 10/1979 Meyer et al.
D274,699 S 7/1984 Epperson
4,691,828 A 9/1987 Slusarczyk et al.
4,850,502 A 7/1989 Davis
D331,703 S 12/1992 Seguin et al.
5,167,336 A 12/1992 Lajovic
D335,453 S 5/1993 Marti
5,632,406 A 5/1997 Robbins, III
D393,803 S 4/1998 Walter
5,740,947 A 4/1998 Flaig et al.
D450,245 S 11/2001 Schultz
D458,140 S * 6/2002 Hutchins ..... D9/523
6,588,612 B1 7/2003 Dorn et al.
D485,170 S 1/2004 Hay et al.
6,907,703 B2 6/2005 Gonzalez
D509,144 S 9/2005 Snyder
6,964,345 B2 11/2005 Wetherell, Jr.
7,000,794 B2 2/2006 Soehnlen et al.
D519,378 S * 4/2006 Abadinsky ..... D9/522
(Continued)

FOREIGN PATENT DOCUMENTS

WO 2011022585 A2 2/2011

*Primary Examiner* — James N Smalley
*Assistant Examiner* — Madison L Poos
(74) *Attorney, Agent, or Firm* — St. Onge Steward Johnston & Reens, LLC

(57) ABSTRACT

A container having a center portion and two side portions each situated at an angle to the center portion and extending in opposite directions such that the a left half of the container is substantially identical to a right half of the container but rotated 180 degrees to form a "Z" shaped profile of the container. This "Z" shaped profile allows containers to be stacked upon each other to provide space savings in storage and shipping of the container and the container when filled with liquid.

25 Claims, 18 Drawing Sheets

(56) References Cited

U.S. PATENT DOCUMENTS

| | | | | |
|---|---|---|---|---|
| D556,058 | S | 11/2007 | Bowers et al. | |
| D558,604 | S | 1/2008 | Dohm et al. | |
| D559,108 | S | 1/2008 | Regas | |
| D573,473 | S * | 7/2008 | Kruparova | D9/522 |
| 7,661,549 | B2 | 2/2010 | Rae | |
| 8,201,699 | B2 * | 6/2012 | Zummo | B65D 1/0223 206/504 |
| 8,763,826 | B1 | 7/2014 | Smith et al. | |
| 2009/0039078 | A1 | 2/2009 | Sanfilippo et al. | |
| 2009/0255893 | A1 | 10/2009 | Zummo et al. | |
| 2013/0255797 | A1 * | 10/2013 | Coulon | B60K 15/03519 137/386 |

* cited by examiner

CONTAINER SYSTEM AND APPARATUS

FIELD OF THE INVENTION

The invention relates to a container, and more specifically to a stackable container system and apparatus for storing matter such as liquids and solids.

BACKGROUND OF THE INVENTION

Many containers for storing liquids and solids are known. Some of such containers are nestable or stackable with other like containers. For example, U.S. Pat. No. 6,588,612 to Dorn et al. discloses an essentially square container with protrusions and depressions for nesting with protrusions and depressions of an adjacent container. The Dorn container includes a substantial number of such protrusions and depressions extending across at least fifty percent of each sidewall.

U.S. Pat. No. 5,167,336 to Lajovic discloses containers that can be stacked in an overlapping and staggered manner to form a close packed array. Each container includes upwardly extending projectiles to mate with flanges on the bottom of like containers. In addition to stacking top to bottom, the containers disclosed in the Lajovic patent may be stacked side-to-side in an overlapping staggered relationship. However, significantly more storage space is necessary because of the staggered configuration (i.e., the end of one container lies adjacent the central region of a like container). Furthermore, no means to carry or transport the container is provided.

U.S. Pat. No. 3,933,268 to Buske discloses a container for packing liquids adapted to inter-engage with an identical container. Each container of the Buske patent has a lateral face with means, such as teeth or serrations, for engaging corresponding faces of similar containers. However, the containers are only stackable in one configuration and, in fact, the engaging means are operative only in one direction.

The above described references therefore do not teach a container that is easily stackable in several different arrangements. Furthermore, none of the prior art containers provide an easy means to carry the container or to adjust its position from any number of vantage points.

It is therefore desired to provide an improved container system and apparatus which overcomes the drawbacks of the prior art.

SUMMARY OF THE INVENTION

Accordingly, it is an object of the present invention to provide a container system and apparatus having a particular exterior contour which enable interlocking with adjacent containers, either alone or in combination with protrusions and indentations. It is a further object of the present invention to provide such a container system and apparatus in which containers are stackable in multiple configurations.

It is another object of the present invention to provide a container system that avoids overfilling and spillage.

It is yet another object of the present invention to provide a container apparatus that includes a reserve volume that can be accessed once a primary volume has been used.

It is a further object to provide a container apparatus having a particular shape optimized for carrying. It is a further object of the present invention to provide such a container having at least one, and preferably several, integrated handle for ease of manipulation and transport.

These and other objects are achieved by providing a container having a center portion and two side portions each situated at an angle to the center portion and extending in opposite directions such that the a left half of the container is substantially identical to a right half of the container but rotated 180 degrees to form a "Z" shaped profile of the container. This "Z" shaped profile allows containers to be stacked upon each other to provide space savings in storage and shipping of the container and the container when filled with liquid.

In one aspect the container has a center portion with two center sidewalls. A first end portion is situated at a first angle with respect to the center portion and includes two first sidewalls. A second end portion is situated at a second angle with respect to the center portion and includes two second sidewalls. An interior cavity is defined at least in part by interior faces of each of the center, first and second sidewalls. An orifice is located in the center portion for passing matter to and from the interior cavity.

In another aspect the container has a center portion with two center sidewalls. A first end portion is situated at a first angle with respect to the center portion and includes two first sidewalls. A second end portion is situated at a second angle with respect to the center portion and includes two second sidewalls. An interior cavity is defined by interior faces of each of the center, first and second sidewalls. An orifice is located in the first end portion for passing matter to and from the interior cavity. A first position is defined when a section of the first end portion adjacent to the center portion is in contact with an external surface at a first contact location and when the second end portion is in also contact with the external surface at a second contact location. A fill line is defined in the first end portion at a maximum height where a liquid is retained in the container when the at least one orifice is open to an external environment when the container is in the first position such that a fill volume is defined when the liquid is at the fill line. An external volume is defined between the first and second contact locations and below a bottom surface of the container. The external volume is less than 20% of an interior volume of the interior cavity.

In another aspect a container apparatus is provided having a liquid reserve portion. The container includes center, first end and second end portions with an interior cavity defined by interior faces of each of the center, first and second sidewalls. An orifice is located in the first end portion for passing matter to and from said interior cavity. A first position is defined when an end of the first end portion is in contact with an external surface at a first contact location and when a section of said second end portion adjacent to the center portion is also contact with the external surface at a second contact location wherein when the at least one orifice is open to an external environment, a portion of liquid in the interior cavity drains from the at least one orifice. A reserve section is defined where a second portion of the liquid remains in the interior cavity when the container apparatus is in the first position, the second portion of liquid having a center of gravity substantially aligned between an end of said second end portion and a point defined where the first end portion and the center portion meet.

In yet another aspect, a container apparatus includes center, first end and second end portions. A central axis intersects the center side walls to define two sides, the first side including the first end portion and part of the center section, the second side including the second end portion and another part of the center section wherein the second side is a mirror of the first side relative to the center axis and rotated 180 degrees about a longitudinal axis of the center section. An interior cavity is defined at least in part by interior faces of each of the center, first and second sidewalls. At least one orifice is located in the center portion for passing matter to and from the interior cavity.

Other objects of the invention and its particular features and advantages will become more apparent from consideration of the following drawings, claims and accompanying detailed description.

DETAILED DESCRIPTION OF THE INVENTION

Figure 1:
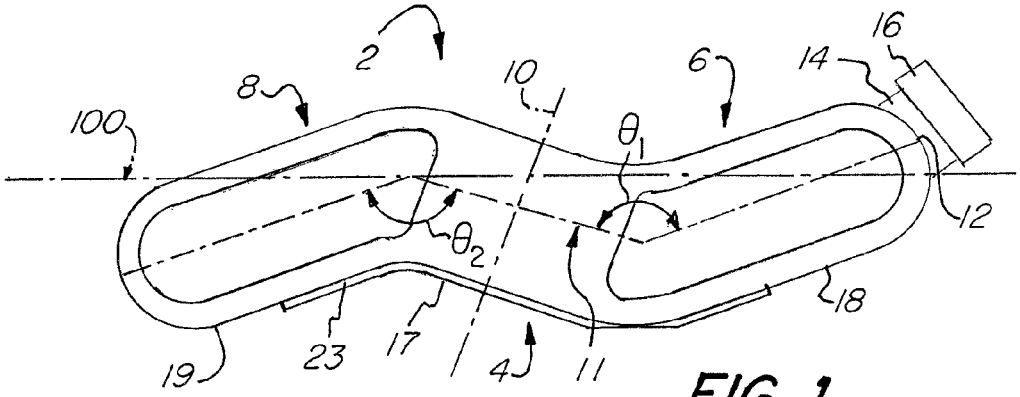
FIG. 1 is a side view of a container according to an exemplary embodiment

FIG. 1 shows a side view of an exemplary container 2 according to the present invention. The container 2 may include or be comprised of any materials. For example, the container 2 may be comprised of one or more polymers, metals or a combination of both. The container 2 is useful for storing and/or transporting any number of liquids or solids. For example, the container 2 may be used for storing fuel on a marine vessel. Some embodiments of the container 2 may also be used for storing drinkable liquids, such as soda or water (e.g., large quantities and/or individual serving sizes).

The container 2 includes a center portion 4. In the exemplary embodiment, the center portion 4 may have a substantially rectangular cross-section with at two or more substantially parallel center sidewalls. For example, the center portion 4 may include two sidewalls having a first length and two sidewalls having a shorter second length, depending on the desired configuration. As shown, the center portion includes two sidewalls. The sidewalls each include an exterior face or surface and an interior face.

The container 2 further includes a first end portion 6 and a second end portion 8. Each end portion 6/8 of the exemplary embodiment may include at least two substantially parallel sidewalls. Each of the first end and second end portions 6/8 may also include two sidewalls. As shown, the first end portion and the second end portion have equal lengths.

Interior faces of the sidewalls of each of the center portion 4 and end portions 6/8 define an interior cavity of the container 2. The interior cavity is suitable for containing matter including any number of fluid compositions, liquids, solids, and/or gases. For example, the interior cavity may include liquid fuel and/or other liquids such as water, soda, juice, etc. The interior cavity may also hold at least some solids. The container 2 further includes at least one orifice 12 for passing the matter to and from the interior cavity. The orifice 12 may be any shape or size and may also include neck 14 extending therefrom and a cap 16 or valve as desired.

FIG. 1 shows a position where the cap 16/orifice 12 are in the elevated position and a fill line is defined at the level of the bottom of the orifice. The fill line may be defined as a maximum level of a liquid where the liquid is retained at the orifice. It is understood that in embodiments where the neck extends out and up from the orifice, additional liquid may be retained above the fill line. In some cases, the neck may extend level or The container 2 further includes at least one handle for ease of carrying and/or manipulating the position of the container 2. In some embodiments, the container 2 includes a handle 20 integrated in the center section 4. The container 2 may also, alternatively or in combination, include handles 22 and/or 24 in the first end portion and second end portion, respectively. In the exemplary embodiment the handles 20/22/24 are substantially flush with exterior faces of the container 2. For example, the handle 20 is substantially flush with a plane defined by an exterior face of a center sidewall and each of the handles 22/24 are flush with curved exterior faces (e.g., distal sidewalls) of the end portions 6/8.

Figure 2:
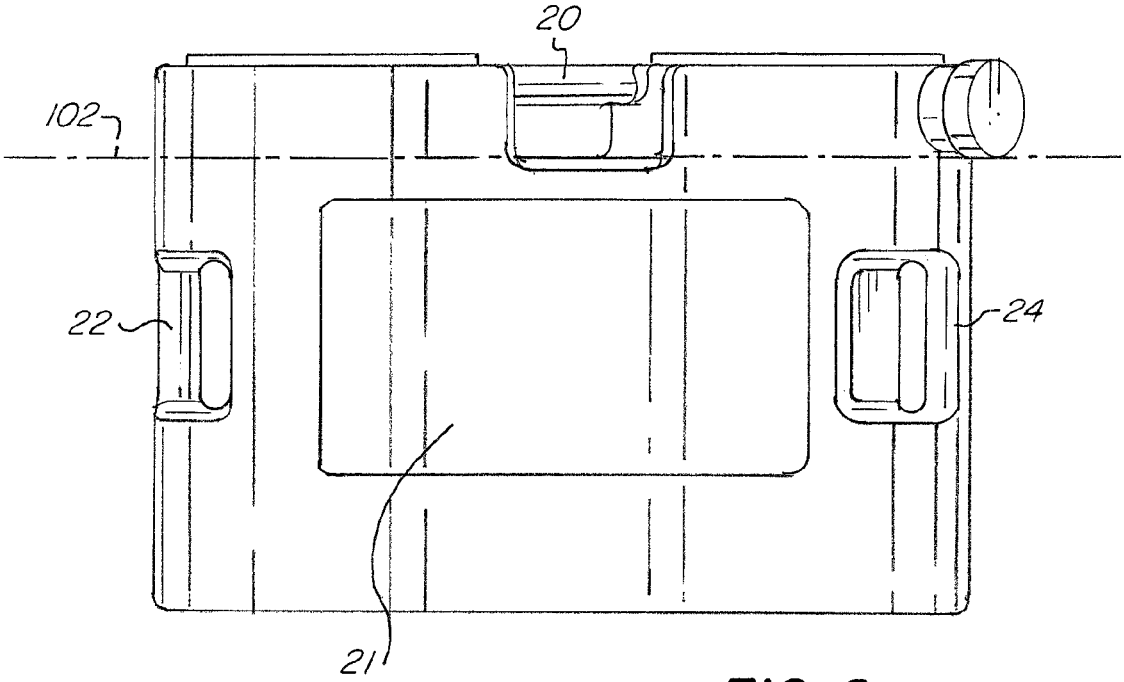
FIG. 2 is atop view of the container of FIG. 1.

FIG. 2 shows another perspective view of the container 2. As shown, the first end portion 6 is situated at a first angle $\Theta_1$ with respect to the center portion 4. The second end portion 8 is situated at a second angle $\Theta_2$ with respect to the center portion 4. The angles $\Theta_1$ and $\Theta_2$ may be determined with respect to sidewalls (e.g., top sidewall) of the center and end portions and/or planes defined by each of the portions. For example, a plane defined by the center portion 4 may be a plane defined by one of the top or bottom sidewalls, or a plane parallel to each. As shown, the angles are determined by the center lines of the first, second and center portions as appropriate. The first angle $\Theta_1$ and the second angle $\Theta_2$ are shown as equal when measured with respect to the longitudinal axis 11 (or centerline) of the center portion. In preferred embodiments, the first and second angles are between zero (0) and one hundred and eighty (180) degrees. In some preferred embodiments the angles are between 175 and 120 degrees or in some preferred embodiments between 170 and 140 degrees.

In the embodiment shown, a central axis 10 is defined through the center portion. This axis may also be perpendicular to the center sidewalls and/or the longitudinal axis 11. First and second sides may be defined on either side of the center axis 10 and the second side (to the left of longitudinal axis 11 as shown in FIG. 1) may be a mirror image of the first side (right of axis 11) but rotated 180 degrees about the longitudinal axis 11. This may give the container 2 an undulating profile.

In FIG. 2 a second fill line 102 is shown when the container 2 is in a second position with the side wall opposite the orifice/neck facing downwards. In this embodiment, the neck is generally parallel to the fill line and the bottom of the orifice 12 is aligned with the bottom of the opening at the end of the neck. In one advantageous embodiment, the empty space above the fill line 102 and 100 in each position is substantially equal. Therefore, assuming the container is placed on a level surface in either position shown in FIG. 1 or 2, spillage would be avoided.

Depending on the liquid in the container, the empty space above the fill line may be necessary for appropriate codes. As one example, volatile liquids such as engine marine engine or automotive fuel may have a greater tendency to expand than water, and the empty space may be needed to reduce the likelihood of too great of a pressure buildup when the tank is exposed to sunlight or is otherwise elevated in temperature.

As shown in FIGS. 1 and 2, the container 2 may include at least one indentation 5 and at least one protrusion 3. An indentation 5 may engage a protrusion 3 on an adjacent container to permit stacking. Preferably the container 2 includes one or more indentations 5 on an exterior face (e.g., shorter length face) of each of the end portions 6/8 and one or more protrusions 3 on the opposite exterior face of each. As shown in FIGS. 3A and 3B, the container 2 may optionally include indentations 5 and/or protrusions 3 on the longer faces of each of the first and second portions 6/8.

Figure 7:
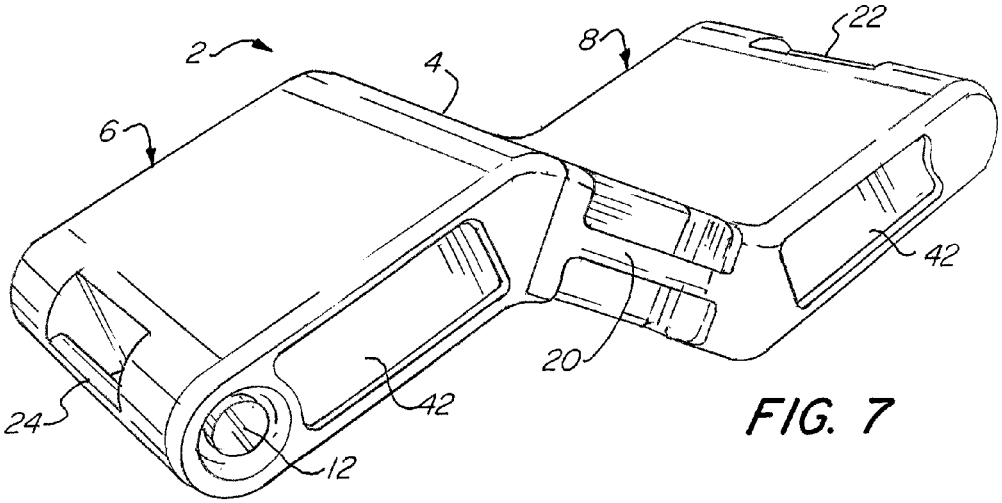
FIG. 7 is a side view of an embodiment of the container in FIG. 1
Figure 8:
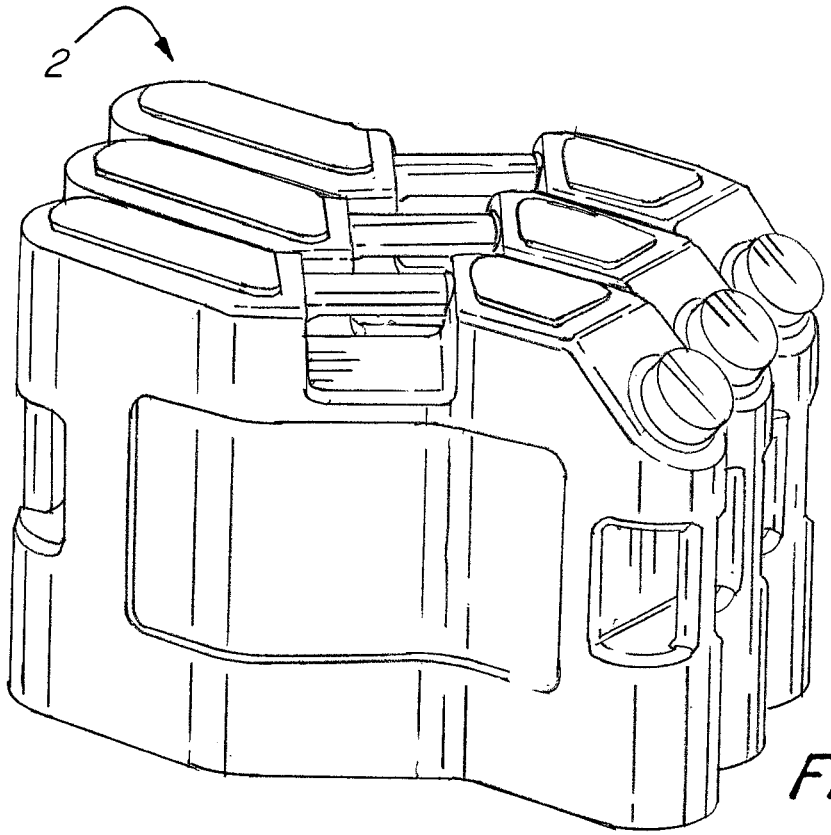
FIGS. 8 and 9 show three containers of FIG. 3 stacked together.
Figure 11:
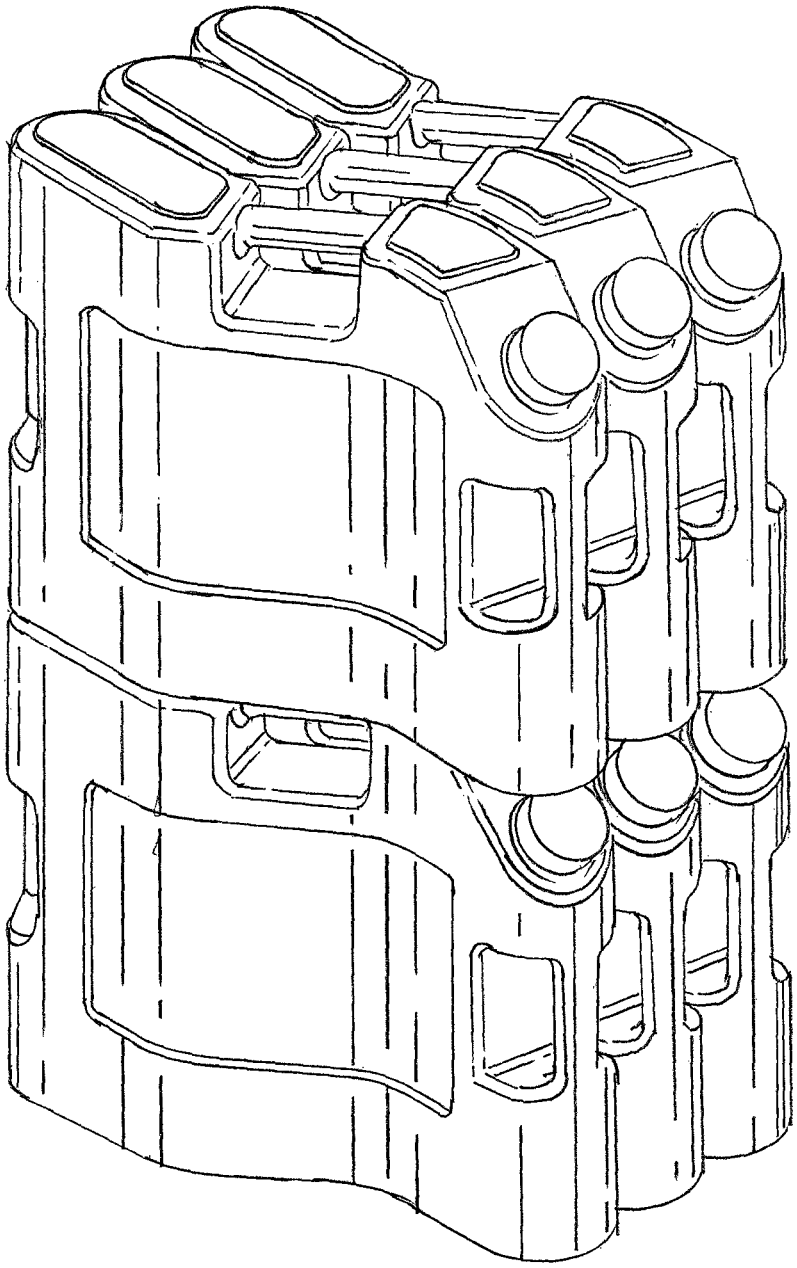
FIG. 11 shows six containers according to FIG. 3 stacked together in two rows.

The container 2 according to the present invention is stackable with one or more like containers in at least two orientations. For example FIGS. 7-11 show multiple containers in various stacked orientations and/or a container system. As shown in FIG. 7/8, containers 2 are stacked such that protrusions 23 engage recesses 21. In FIG. 11, indentations 5 of one container engage protrusions 3 stack the containers upwards and protrusions 23 engage recesses 21 to stack containers sideways. It is understood that depending on the desired configuration and shelf space that FIG. 11 could be rotated 90 degrees such that the vertical stacking is accomplished by protrusions 23 engaging recesses 21.

Figure 3:
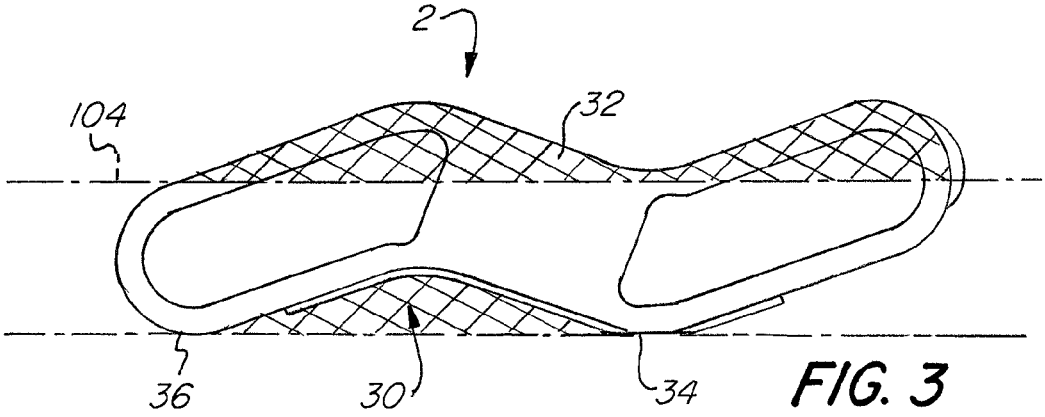
FIG. 3 is a side view of an embodiment of the container in FIG. 1

Referring to FIG. 3, empty internal volume 32 is defined above fill line 104 and empty external area 30 is defined below the bottom surface of the container and between contact points 36/34. In some preferred embodiments, the empty internal volume 32 may account for up to 25% of the total internal volume of the container. In some preferred embodiments, the empty internal volume is between 5% and 20% or more preferably between 7 and 17% of the total internal volume. The empty external volume 30 may account for up to 15% of the total internal volume of the container. In some preferred embodiments, the empty external volume may account for 2% to 10% or more preferably between 3% and 7% of the total internal volume of the container.

Although not shown, containers of different volumes could be stacked upon each other assuming the length of the center section and the angles $\Theta_1$ and $\Theta_2$ match the other containers being stacked.

Figure 4:
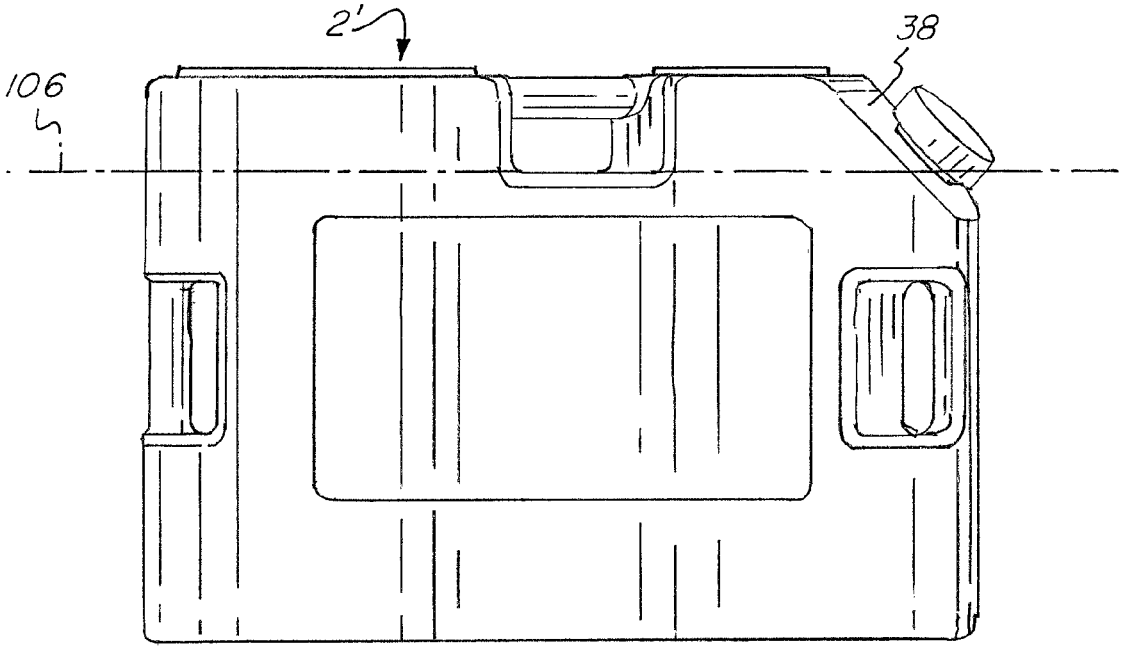
FIG. 4 is a top view of the container in FIG. 3

In FIG. 4, fill line 106 is shown with the container 2 in a position where the wall 39 opposite the orifice resting on the ground or an external surface. The empty volume above the fill line 106 may be equal volume 32, which may prevent spillage. As shown in FIG. 4, the orifice 12 and neck 14 are located on an angled surface 38 which may allow the cap 16 to not extend as far out from the end 37 in comparison to the embodiment shown in FIG. 1.

Figure 5:
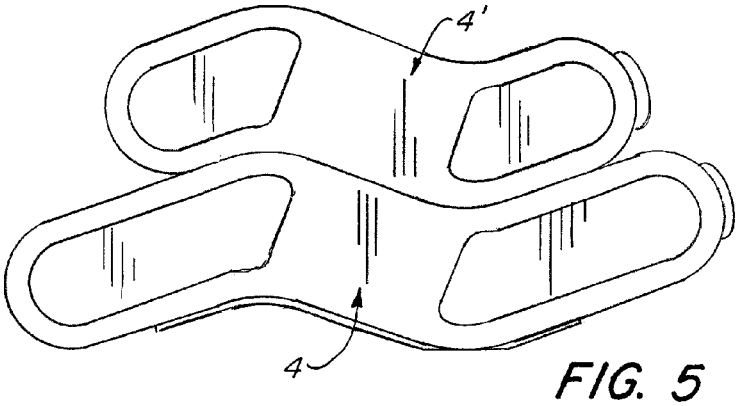
FIG. 5 is a side view of the container of FIG. 1 with a smaller container similar to that of FIG. 1 stacked thereon.

In FIG. 5, two containers of different sizes are shown stacked upon each other. As can be seen the angles and the length of the center section match for both containers, which allows for proper nesting.

Figure 6:
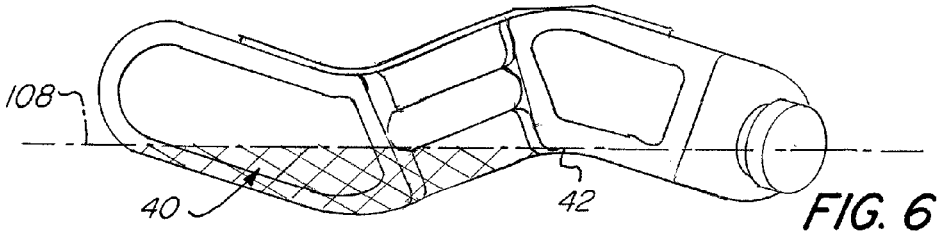
FIG. 6 is a side view of the container of FIG. 3 in an alternate position.

In FIG. 6, the container 2 is shown upside down in comparison to FIG. 3. In this position, a reserve volume 40 is created below reserve line 108. In an example where the container 2 is filled with gasoline for a motorboat engine, the volume of liquid above reserve line 108 and the volume below the reserve line in the section closest to the orifice would be used by the engine. The engine would then run out of fuel, providing an indication to the user that he/she is almost out of fuel. The user would then be able to tilt the container to cause the reserve volume 40 of fuel to move towards the orifice and use the reserve volume 40 to return back to the dock or launching location. The reserve volume 40 may account for up to 30% or more preferably 5-25% or yet more preferably 7-17% of the total internal volume of the container.

Figure 9:
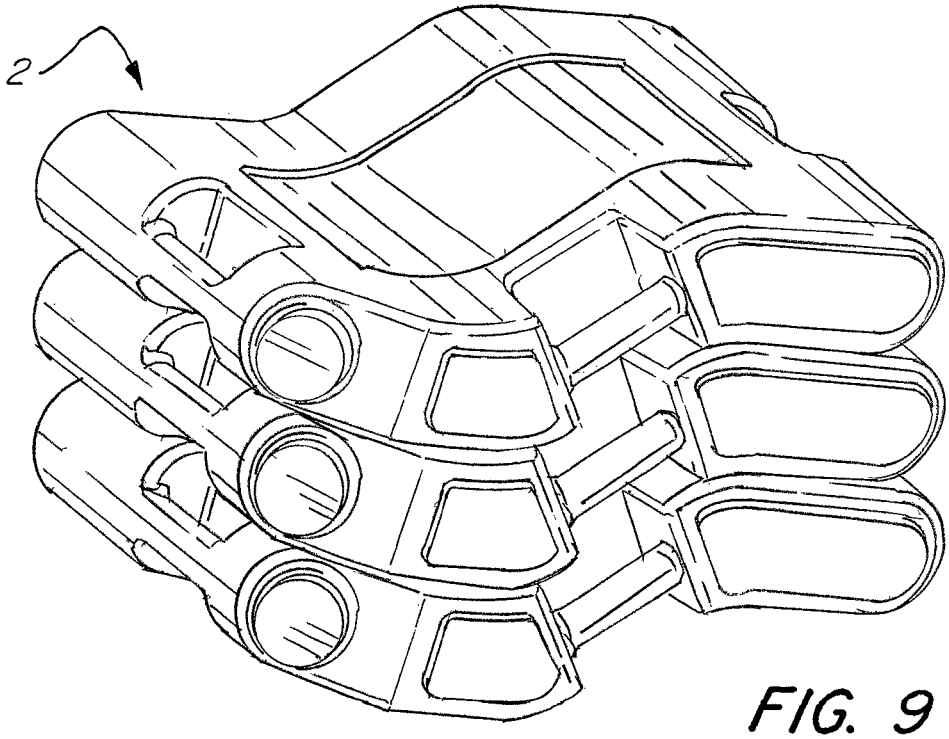
Figure 10:
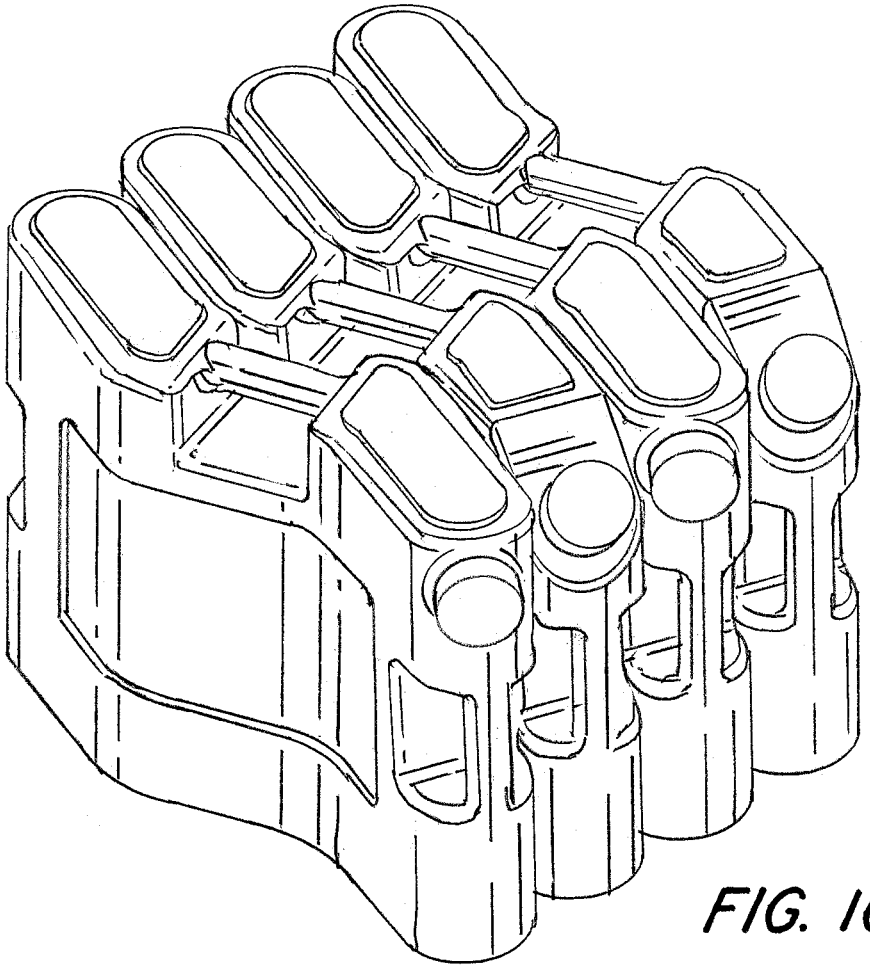
FIG. 10 shows two containers according to FIG. 1 and two containers according to FIG. 3 stacked together.
Figure 15:
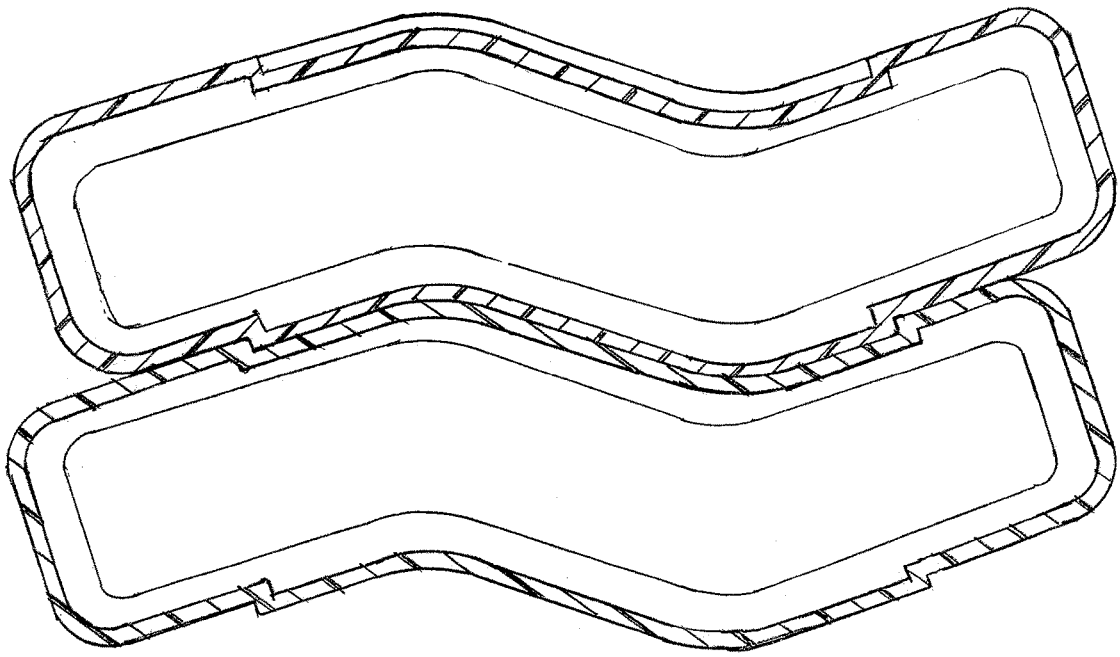
FIG. 15 shows a side cross sectional view of two containers stacked on top of each other, the cross section along the plane in FIG. 16.
Figure 16:
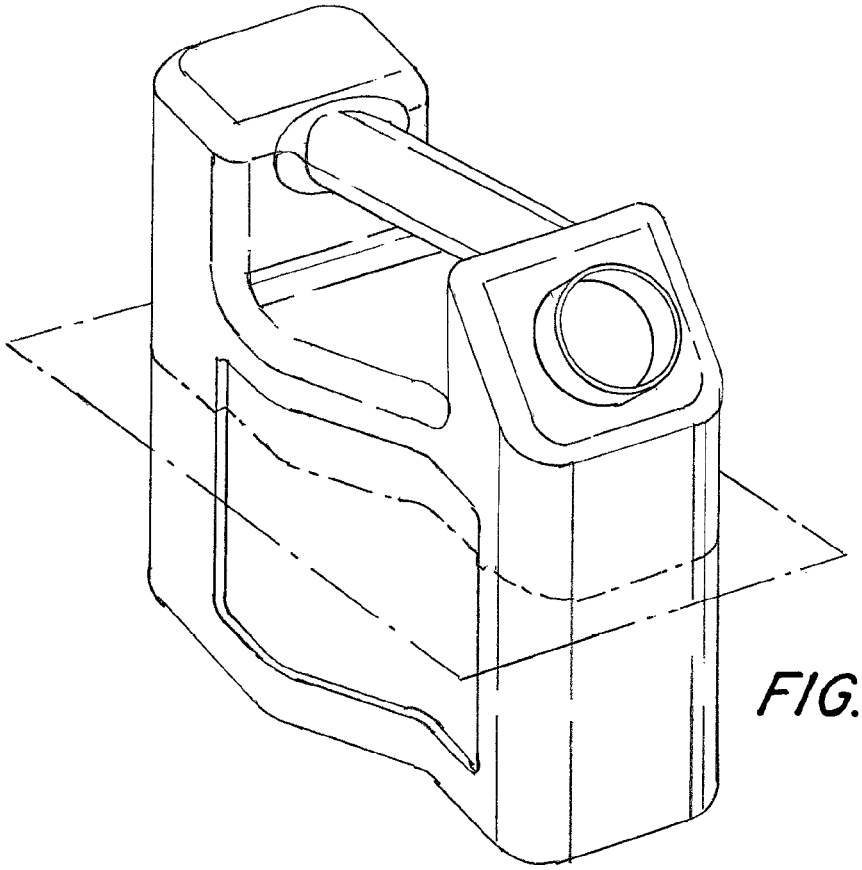
FIG. 16 shows a perspective view of an embodiment of the container according to the present invention.
Figure 17:
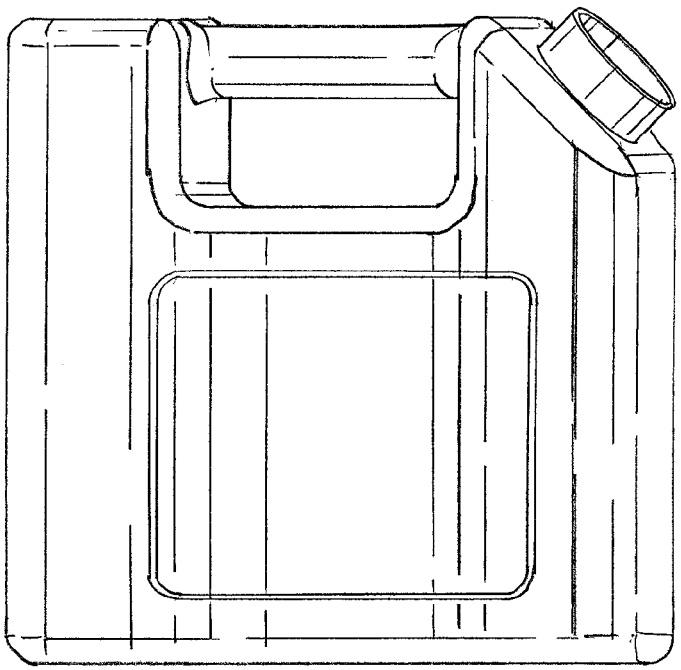
FIG. 17 shows a side view of the container in FIG. 16

FIG. 7 shows another embodiment of the container 2 with the orifice located in the wall of the first side portion 6. FIGS. 8-11 show the containers shown herein nested or stacked together. FIG. 9 shows different embodiments of the container 2 stacked together. When stacked together, the protrusions/indentations 3/5 and/or protrusions/recesses 23/21 engage with each other as the containers are stacked to resist the containers from sliding relative to each other. A cross section of protrusions/recesses engaging is shown in FIG. 15.

Figure 12:
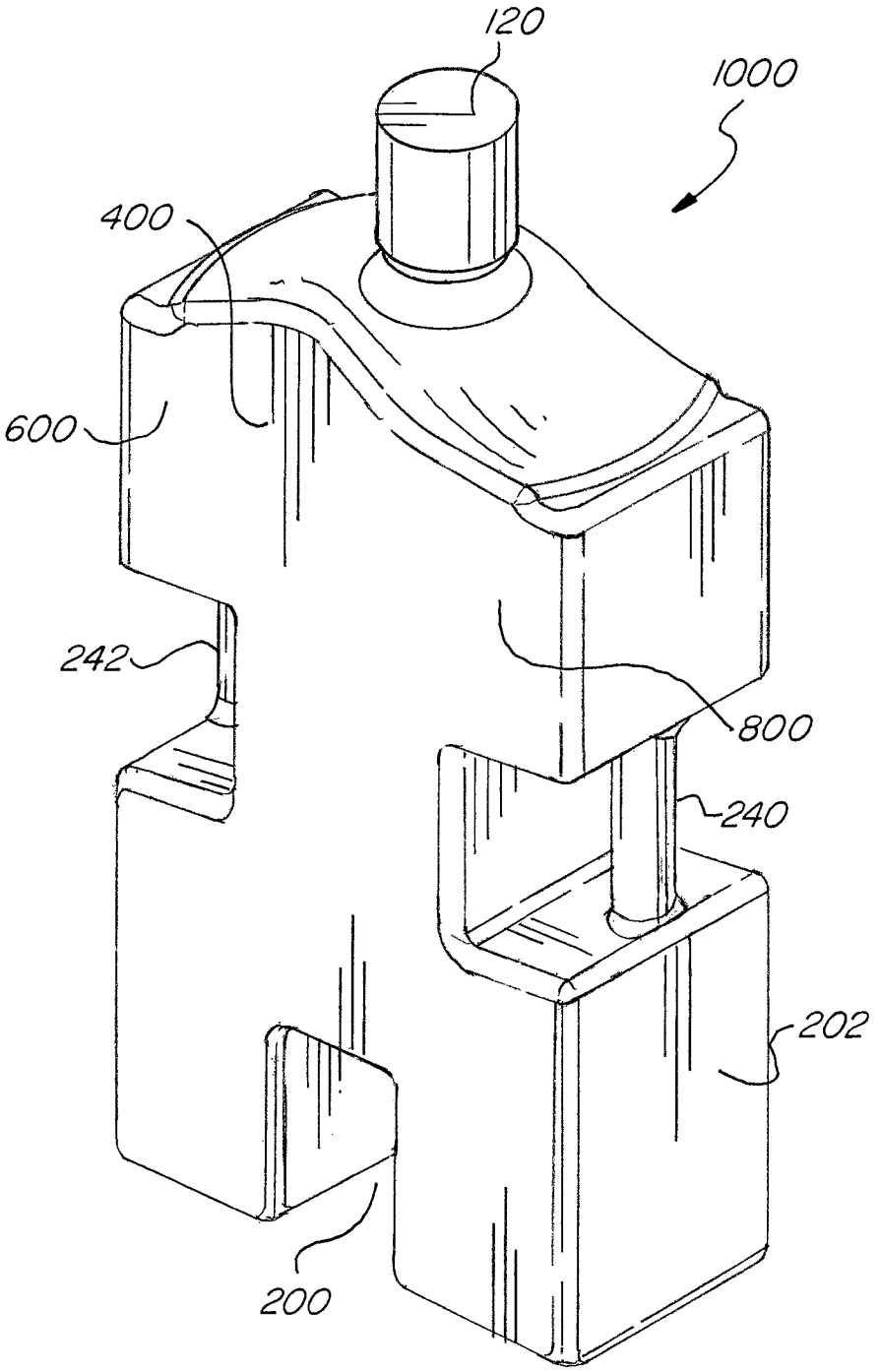
FIG. 12 shows a top perspective view of an exemplary embodiment of a container designed for a water dispenser.
Figure 13:
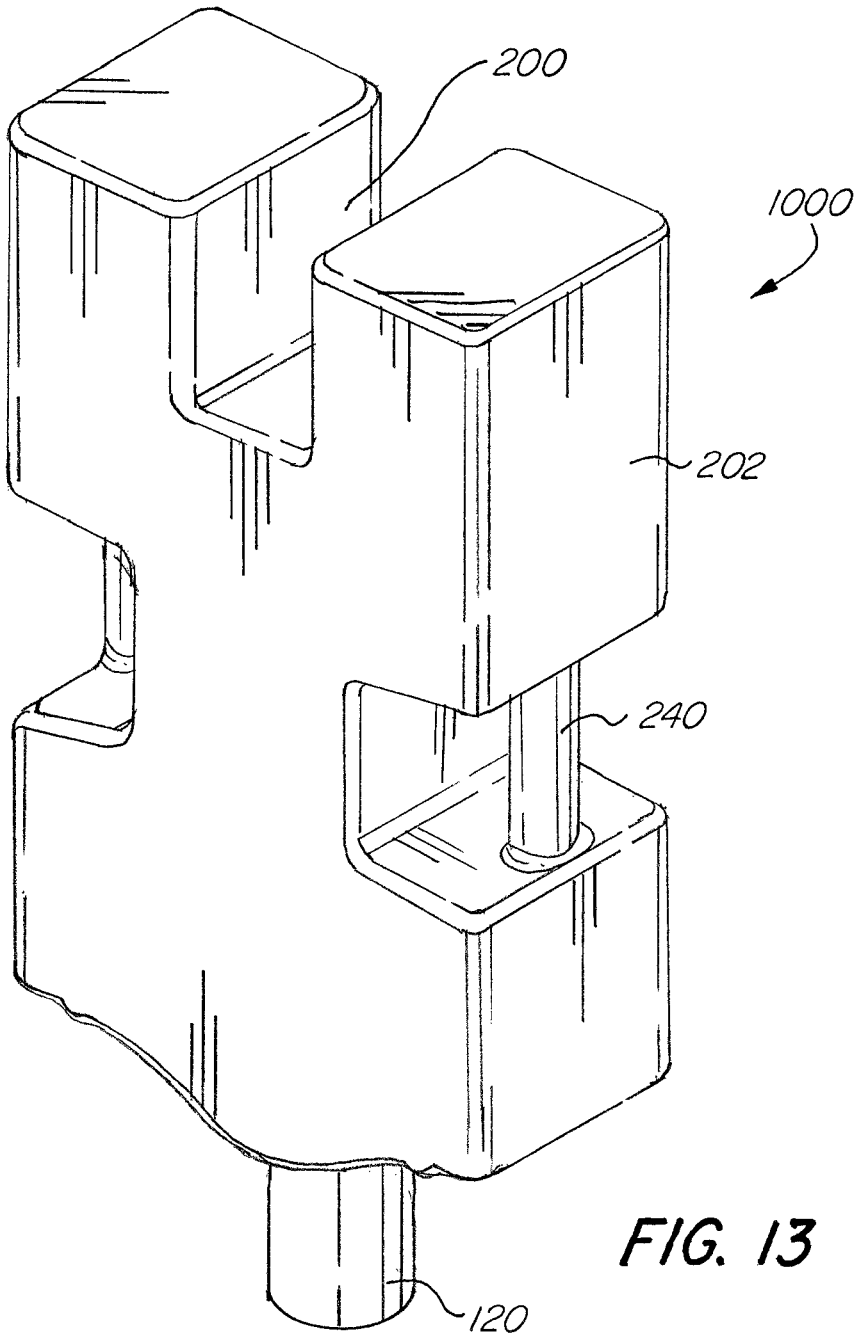
FIG. 13 shows a bottom perspective view of FIG. 11
Figure 14:
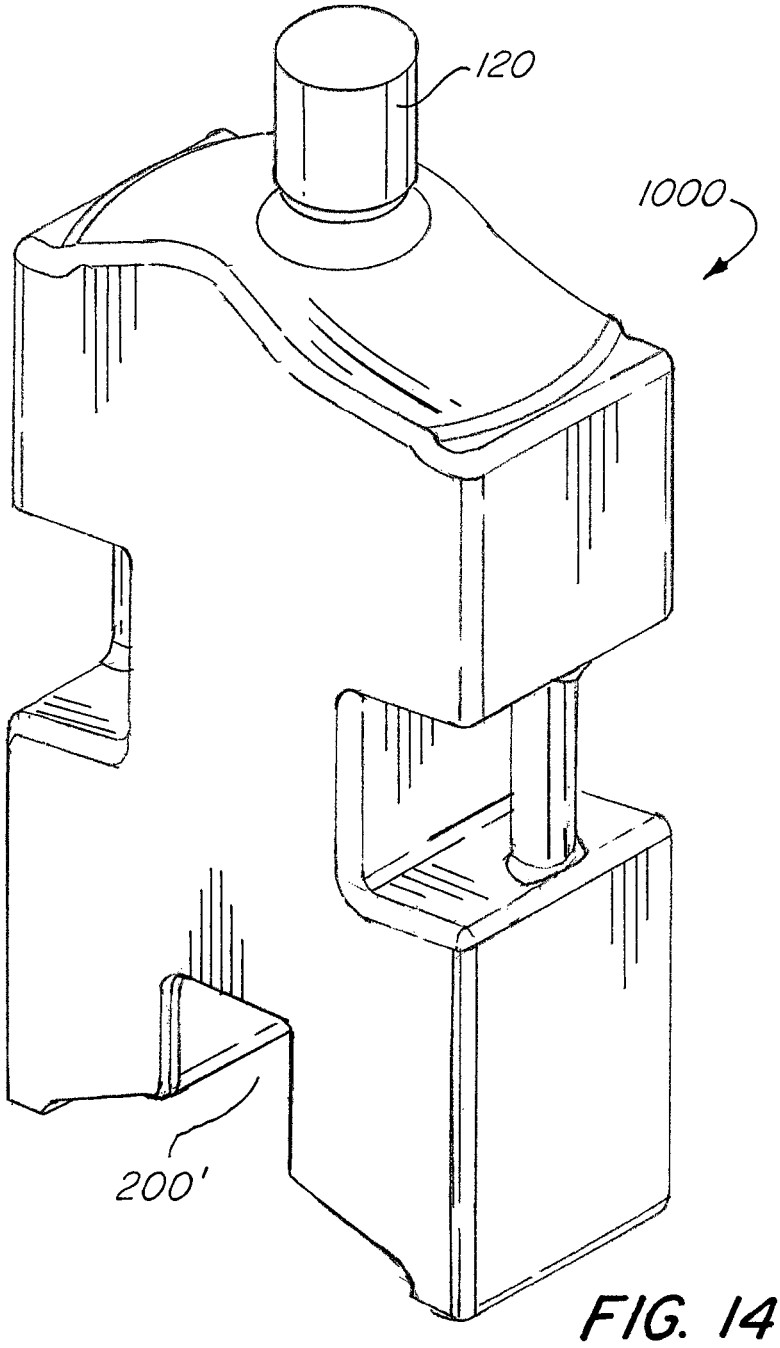
FIG. 14 shows a top view of an alternate embodiment of the container of FIG. 11.
Figure 19:
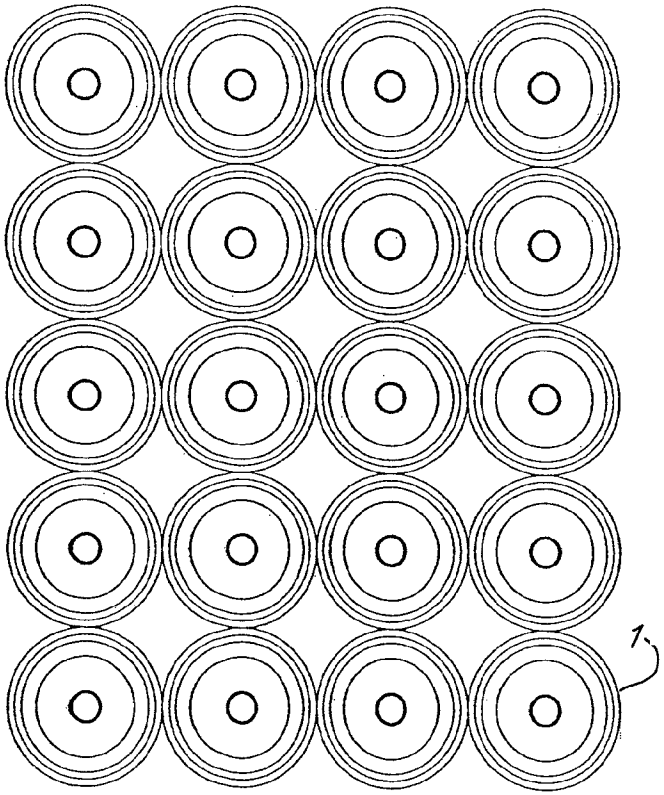
FIG. 19 shows a stack of prior art water dispenser bottles.

FIG. 12 shows an embodiment of the container 1000 where the orifice is located in the center portion 400 where the neck 120 is. The neck extends from an end wall of the center portion 400. One end wall includes recess 200 that allows the neck 120 of a different bottle to insert therein. Optionally, the recess 200 is not included or shaped differently as shown FIG. 14 (200'). The bottles can also stack upon each other up the side walls. The configuration shown may be designed to replace a cylindrical shaped water bottle commonly found water coolers/heaters. The configuration shown like other embodiments of the container 2 allow for easy stacking and transportation. The current cylindrical shaped water bottles (FIG. 19) often require plastic carrying cases in specialized trucks so that the bottles can be stacked, and the embodiment shown enables easier stacking, transportation and storage. The stack of FIG. 19 would not actually be stable in the position shown, and would require shelving or other supports whereas the water bottles shown can stack directly upon each other.

Figure 18:
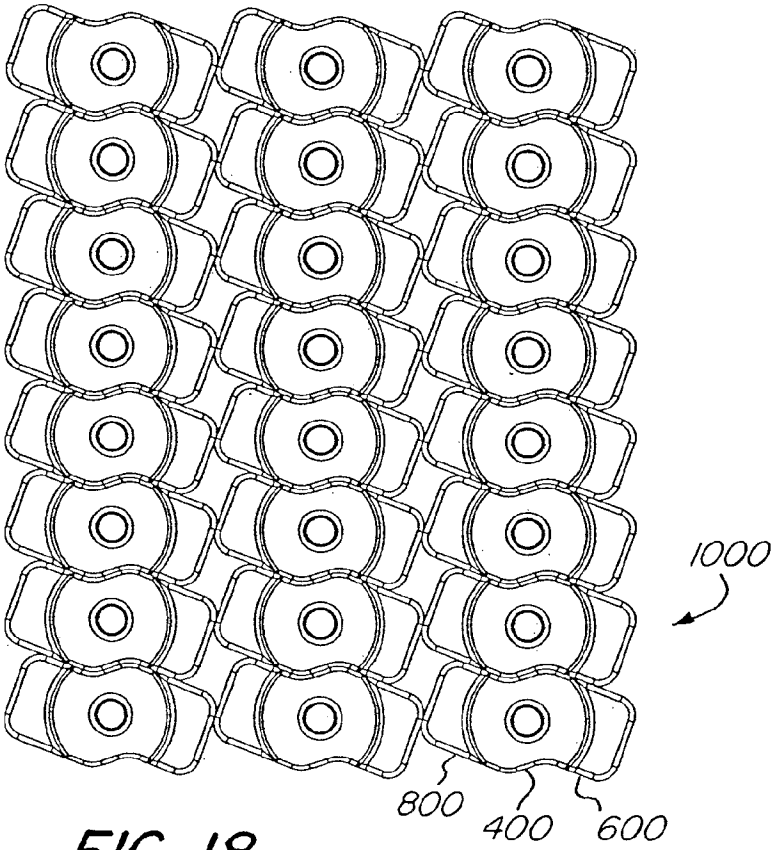
FIG. 18 shows a stack of water dispenser container bottles according to the present invention.
Figure 20:
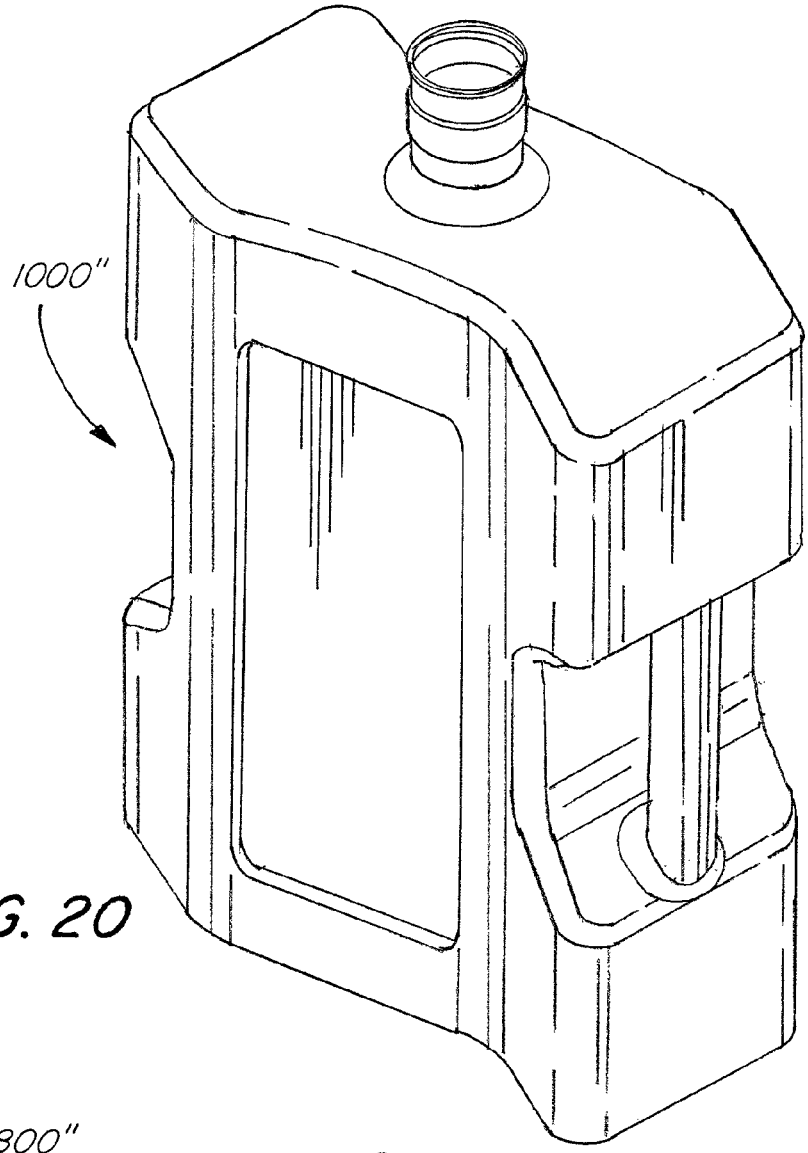
FIG. 20 shows a perspective view of an alternate water dispenser container bottle.

The stack of water cooler container bottles is shown in FIG. 18 where the center section is shorter than the side sections. In an alternate embodiment depicted in FIGS. 20-22, the container 1000" has side sections 800/200" and center section 400". Length A as shown in longer than length B. In some preferred embodiments, Length A is 10-30% longer than Length B. Length B could also be longer than length B, for example B could be 10-30% longer than A. As shown in FIG. 22, a total of 24 water dispenser container bottles would take up approximately the same space as the 20 bottles shown in FIG. 19, and all bottles would be of the same size (5 gallons in this example case).

Figure 21:
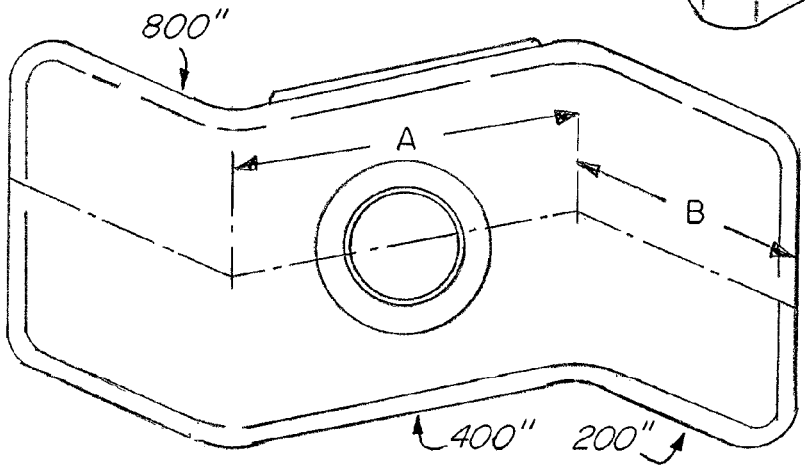
FIG. 21 shows a side view of the container in FIG. 20.
Figure 22:
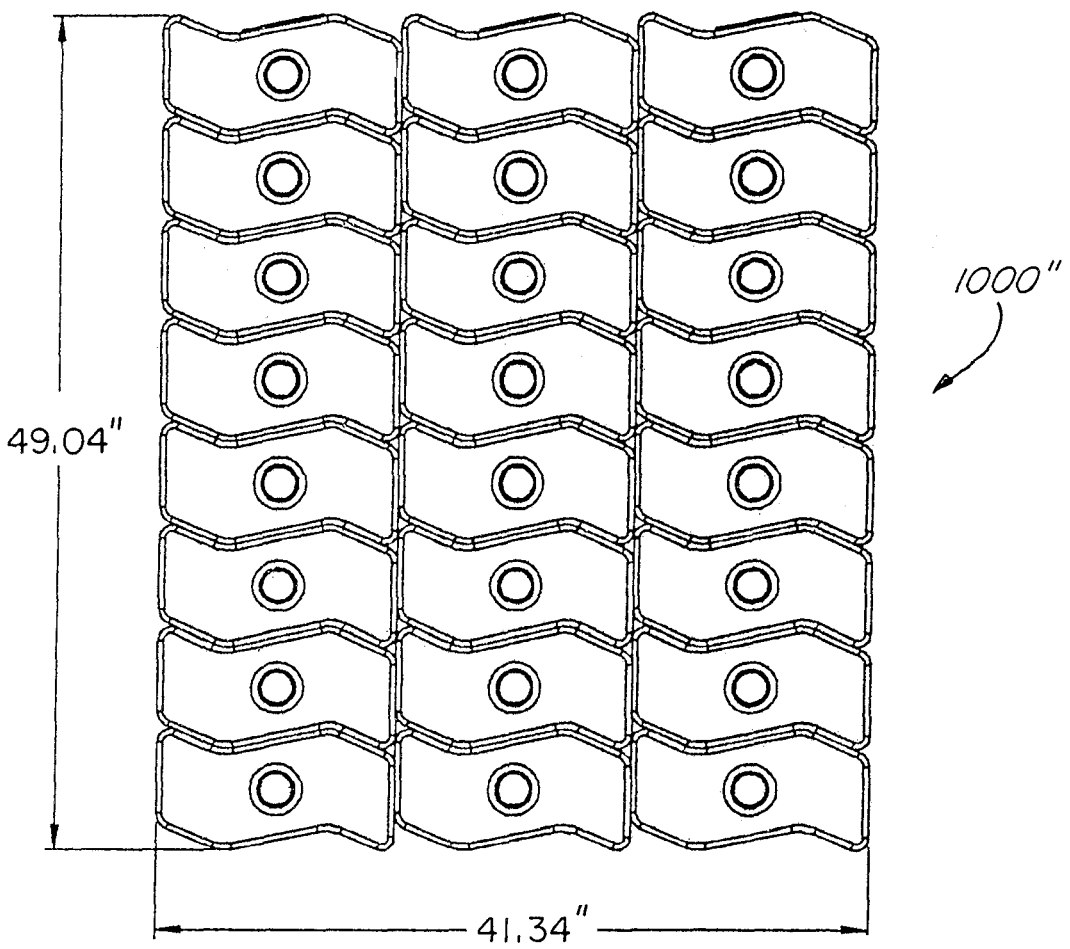
FIG. 22 shows a stack the containers in FIGS. 20-21.

As also shown in FIG. 21, the distance C between the center sidewalls may also be greater than 15% of the width D of the container. In some embodiments, the distance C is 20-50% or more preferably 25-40% or even more preferably 30-40% of distance D.

Figure 23:
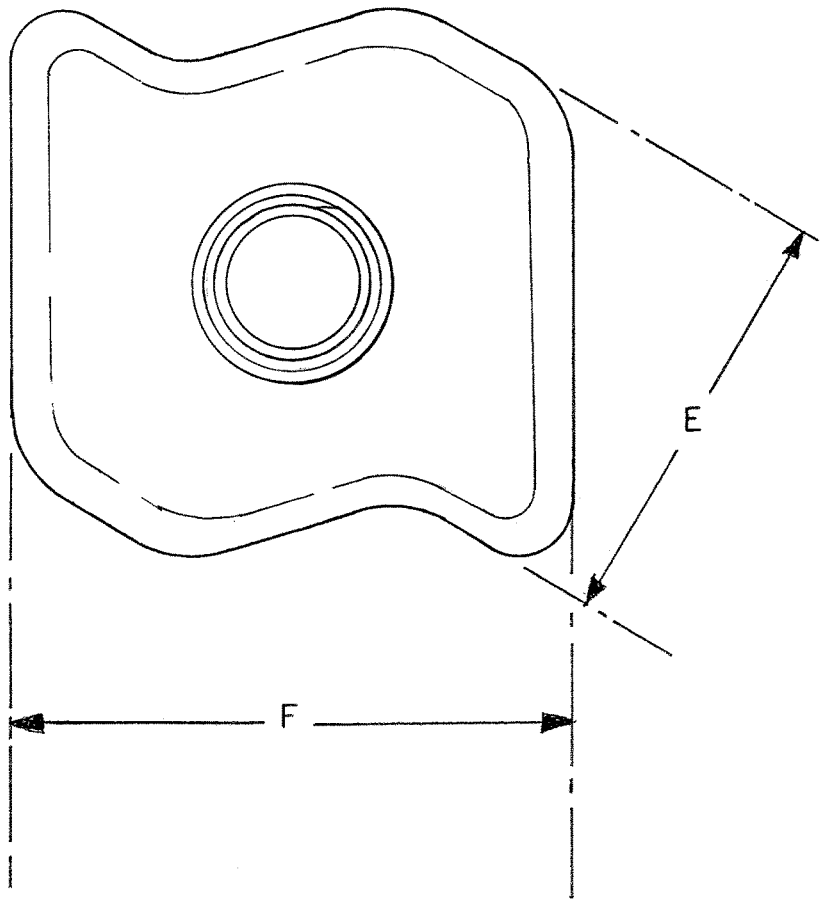
FIG. 23 shows a section view of an alternate embodiment of a water bottle.
Figure 24:
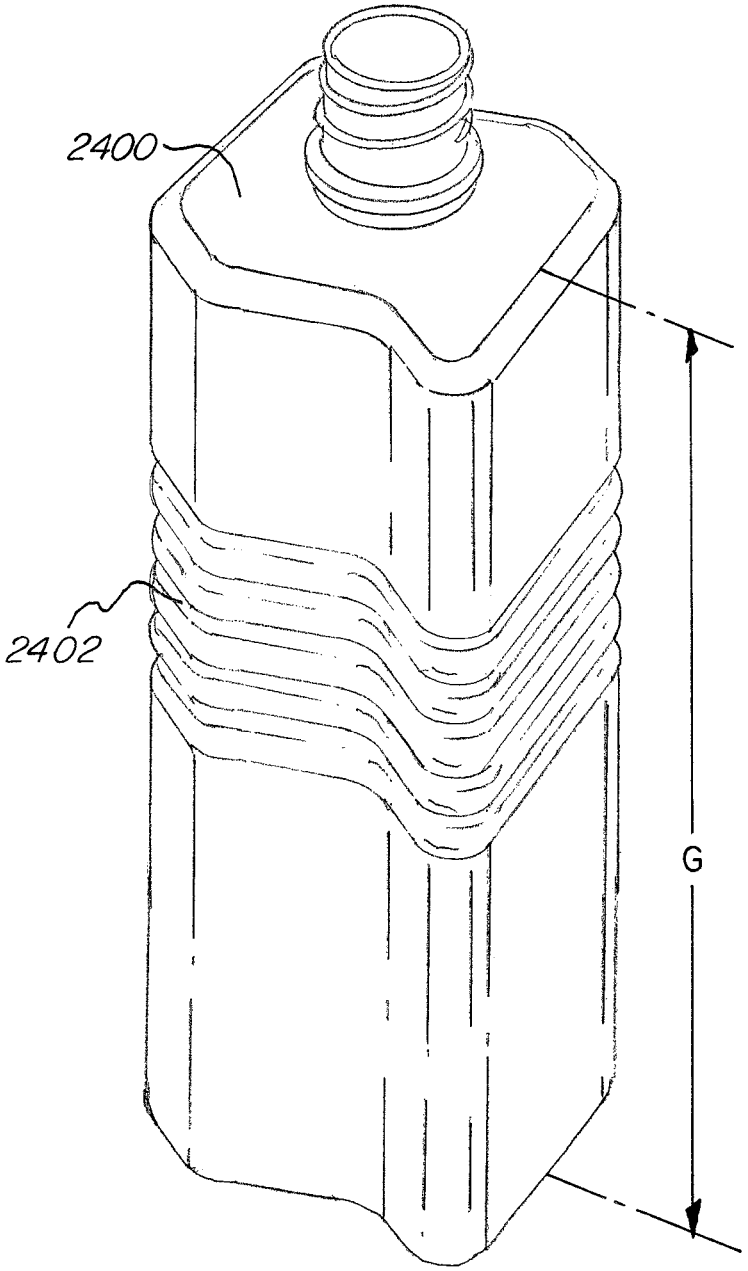
FIG. 24 shows a perspective view of the water bottle of FIG. 23.
Figure 25:
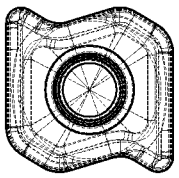
FIGS. 25-30 are respectively top, perspective, left side, front, right side and bottom views of an alternate embodiment of a water bottle.
Figure 26:
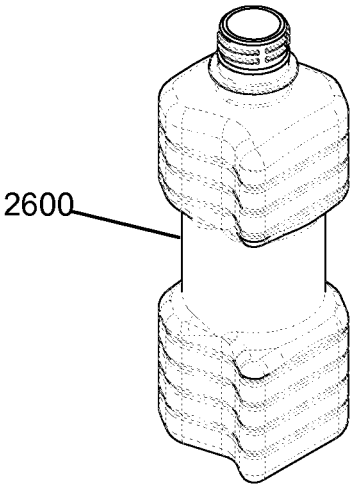
Figure 27:
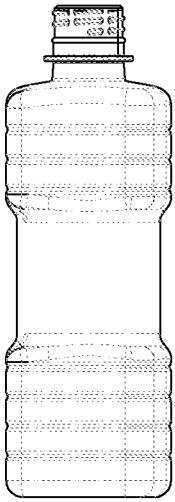
Figure 28:
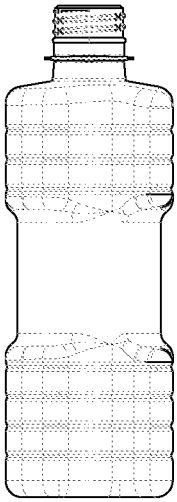
Figure 29:
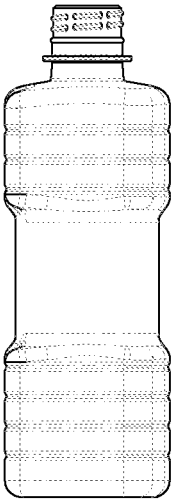
Figure 30:
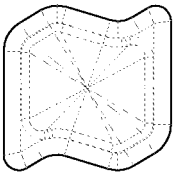
Figure 31:
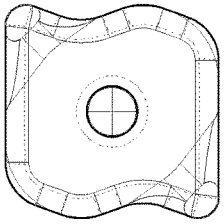
FIGS. 31-37 are respectively top, perspective, right side, front, left side, bottom and oblique views of an alternate embodiment of a water bottle.
Figure 32:
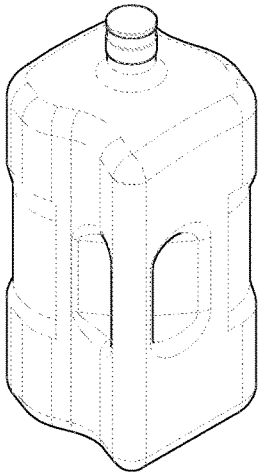
Figure 33:
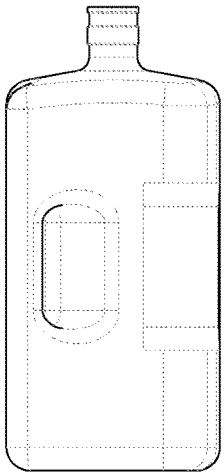
Figure 34:
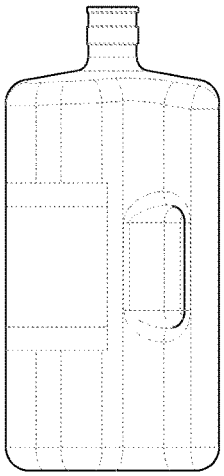
Figure 35:
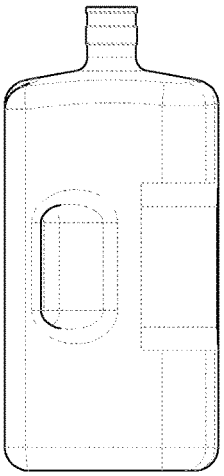
Figure 36:
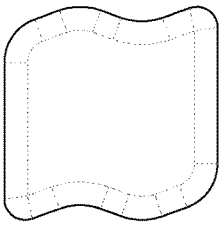
Figure 37:
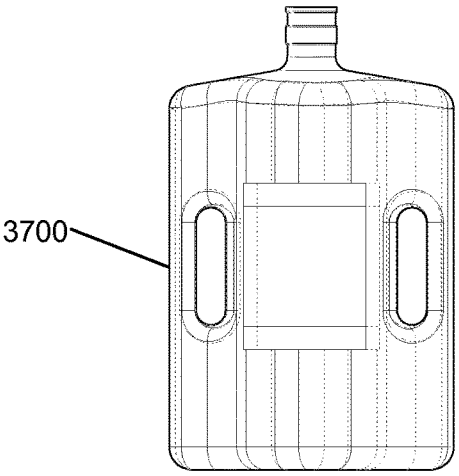

In another embodiment shown in FIGS. 23 and 24, the distance E between the center sidewalls is at least 60% or more preferably at least 75% of the width F. When the E is 60% or more of F, the height G of the container may be greater than both E and F. In FIG. 24, channels 2402 are shown in part of the bottle. These channels 2402 may extend along more of the height G than shown. The channels allow for compression of the bottle 2400 once used to take up less space in trash or recycling bins.

Referring to FIG. 23, an example of a 16 ounce water bottle is shown with exemplary dimensions. Although not shown in this drawing, the orifice/mouth would extend out of the page and the cross section shown would generally extend from the bottom of the water bottle to the base of the orifice (height). In some embodiments the ratio of D:C: height is 12:37:9 to allow the water bottle to fit inside standard sized cup-holders and dispenser/display shelves of the traditional 16 ounce round water bottle. Other D:C: height ratios could be in the range of 9-15:30-40:7-11. Although the drawing shows water bottle designed to hold 16 ounces of water with the appropriate dimensions (height approx. 185 mm), the dimensions shown along with the height (distance from bottom to base of orifice) could be increased or decreased to accommodate different volumes of water as would be apparent to one of skill in the art. The ratio of D:C:height in different sizes may preferably remain within the ratios and ranges of ratios discussed in this paragraph.

Referring to FIGS. 25-30, a water bottle is shown with a rounded center section 2600 that may allow for easier holding by a user. The ratios described with respect to FIGS. 23-24 may also apply to the center, left side and right side sections of the portions of the water bottle above and below the center section.

Referring to FIGS. 31-37, an alternate container is shown, which may be used in water coolers. This embodiment includes handles 3700 that are positioned where the side section and an end wall meet. In some embodiments, the container shown in FIGS. 31-37 is stacked upon the end walls through interlocking protrusions and recesses. In some embodiments, these protrusions and recesses are offset such that multiple containers stack in an offset pattern such as how bricks are commonly stacked in construction of buildings and the like. In some embodiments, the ratios discussed herein with respect to FIG. 23 also apply to the container shown in FIGS. 31-37.

Although certain sizes are described herein, it is contemplated that the container systems can be smaller or larger depending on the desired application. For example a single serving beverage size (e.g., 8 fl. oz.-20 fl. oz., etc.). The container may alternatively be a larger size such as one intended to hold a substantial capacity of fuel or water (e.g., 6 gallon, 10 gallon, or any other size), e.g., for use on a marine vessel, liquid or water storage, for chemical storage or even granular/solid matter storage.

Although the invention has been described with reference to a particular arrangement of parts, features and the like, these are not intended to exhaust all possible arrangements or features, and indeed many modifications and variations will be ascertainable to those of skill in the art.

What is claimed is:

1. A container apparatus, comprising:

a center portion including at least two center sidewalls including straight sections;

a first end portion extending from said center portion and situated at a first angle with respect to said center portion and including at least two first sidewalls, said first angle between 175 and 120 degrees such that a profile of the container apparatus is undulating;

a second end portion extending from said center portion and situated at a second angle with respect to said center portion and including at least two second sidewalls;

said at least two second sidewalls parallel to said at least two first sidewalls and at an angle with respect to said straight sections of said at least two center sidewalls;

an interior cavity defined at least in part by interior faces of each of said center, first and second sidewalls wherein the interior faces of the at least two first sidewalls face each other and the interior faces of the at least two second sidewalls face each other; and at least one orifice located in said first end portion for passing matter to and from said interior cavity.

2. The apparatus of claim 1 further comprising:

a plurality of container apparatuses;

a top profile of one of the plurality of container apparatuses is defined by one of each of the two center side walls, the at least two first side walls and the at least two second side walls of the one of the plurality of container apparatuses;

a bottom profile of a second one of the plurality of container apparatuses is defined by one of each of the two center side walls, the at least two first side walls and the at least two second side walls of the second one of the plurality of container apparatuses;

wherein the top and bottom profiles match such that the plurality of container apparatuses are stackable.

3. The apparatus of claim 1 further comprising:

a first wall defined between said center, first and second sidewalls wherein said at least one orifice is located in said wall.

4. The apparatus of claim 3 wherein a mouth extends from said orifice, said mouth having an axis perpendicular to said wall.

5. The apparatus of claim 3 further comprising a handle located in a second wall opposite to said first wall wherein said second wall is defined between said center, first and second sidewalls.

6. The apparatus of claim 3 further comprising a recess located in a second wall opposite to said first wall wherein said second wall is defined between said center, first and second sidewalls.

7. The apparatus of claim 1 wherein said center portion is longer than the first end portion.

8. The apparatus of claim 7 wherein the first and second end portions are of substantially equal length.

9. The apparatus of claim 1 further comprising:

a first side including at least part of said first end portion and a portion of said center portion;

a second side including at least part of said second end portion and another portion of said center portion wherein said second side is substantially identical to said first side but rotated 180 degrees with respect to a central axis of said center portion.

10. The apparatus of claim 1 wherein a distance between the center sidewalls is 15-50% of a width of the container.

11. The apparatus of claim 1 further comprising:

a first side including at least part of said first end portion and a portion of said center portion;

a second side including at least part of said second end portion and another portion of said center portion wherein said second side is substantially identical to said first side but rotated 180 degrees with respect to a central axis of said center portion.

12. The apparatus of claim 1 wherein:

a first position is defined when a section of said first end portion adjacent to said center portion is in contact with an external surface at a first contact location and when said second end portion is in also contact with the external surface at a second contact location wherein said two center side walls are positioned at an angle relative to a plane defined by said first and second contact locations;

a fill position defined in said first end portion at a maximum height where a liquid is retained in said container when said at least one orifice is open to an external environment when the container is in said first position such that a fill volume is defined when the liquid is at said fill position;

an external volume defined between said first and second contact locations and below a bottom surface of the container wherein the external volume is less than 20% of an interior volume of the interior cavity.

13. The apparatus of claim 12 wherein the external volume is less than 8% of the interior volume.

14. The apparatus of claim 12 wherein the fill position is tangent to one of said interior faces.

15. The apparatus of claim 12 further comprising:

a first and a second wall each defined between said center, first and second sidewalls;

a second position defined wherein said first wall is in contact with the external surface;

a second fill line defined at a maximum height where the liquid is retained in said container when said at least one orifice is open to the external environment such that a second fill volume is defined by liquid at said second fill line;

wherein said second fill volume is substantially equal to or less than the fill volume.

16. The apparatus of claim 15 further comprising:

a mouth extending from said orifice and adapted to receive a closing member, the closing member when connected to said mouth closing the at least one orifice to the external environment.

17. The apparatus of claim 15 wherein in said second position said orifice is located closer to said second wall than said first wall.

18. The apparatus of claim 1 wherein said first angle is between 170 and 140 degrees.

19. The apparatus of claim 1 wherein the interior faces of the at least two first sidewalls and the interior faces of the at least two second sidewalls face a centerline of the container apparatus.

20. A container apparatus having a liquid reserve portion, comprising:

a center portion including at least two center sidewalls;

a first end portion situated at a first angle with respect to said center portion and including at least two first sidewalls;

a second end portion situated at a second angle with respect to said center portion and including at least two second sidewalls;

an interior cavity defined at least in part by interior faces of each of said center, first and second sidewalls; and at least one orifice located in said first end portion for passing matter to and from said interior cavity;

a first position defined when an end of said first end portion is in contact with an external surface at a first contact location and when a section of said second end portion adjacent to said center portion is also contact with the external surface at a second contact location wherein said two center side walls are positioned at an angle relative to a plane defined by said first and second contact locations;

a reserve section defined where a second portion of the liquid remains in said interior cavity and a first level of liquid in said first end portion is lower than a second level of liquid in said second end portion, when the container apparatus is in said first position, said second portion of liquid having a center of gravity substantially aligned between an end of said second end portion and a point, the point defined where said first end portion and said center portion meet, the second level of liquid in said second end portion defined by a reserve line associated with said second end portion.

21. The apparatus of claim 20 wherein upon elevation of said second end portion off of said second contact point, at least part of the second portion moves into said first end portion.

22. The apparatus of claim 21 wherein when in the first position, said reserve section has a volume of 5-30% of an interior volume of said interior cavity.

23. The apparatus of claim 20 wherein first and second center sidewalls of said at least two center sidewalls are located respectively in first and second planes which are each transverse to the plane defined by said first and second contact locations.

24. A container apparatus, comprising:

a center portion including at least two center sidewalls including substantially straight sections;

a first end portion situated at a first angle with respect to said center portion and including at least two first sidewalls;

a second end portion situated at a second angle with respect to said center portion and including at least two second sidewalls;

said at least two second sidewalls substantially parallel to said at least two first sidewalls and at an angle with respect to said substantially straight sections of said at least two center sidewalls;

an interior cavity defined at least in part by interior faces of each of said center, first and second sidewalls;

at least one orifice located in said first end portion for passing matter to and from said interior cavity; and said two center sidewalls each having a curved portion at either side, said first and second sidewalls extending from one of the curved portions;

wherein each curved portion defines a curved interior face, one curved interior face being convex and another curved interior face being concave.

25. The apparatus of claim 24 wherein said first angle is greater than 0 and less than 180 degrees such that a profile of the container apparatus is undulating.

* * * * *